US007971364B2

(12) United States Patent
Lahille

(10) Patent No.: US 7,971,364 B2
(45) Date of Patent: Jul. 5, 2011

(54) DEVICE TO MONITOR THE POSITION OF AN ASSEMBLY CONTAINING NUCLEAR FUEL IN A STORAGE BASKET HOUSING

(75) Inventor: Roger Lahille, Azas (FR)

(73) Assignee: TN International, Montigny le Bretonneux (FR)

( * ) Notice: Subject to any disclaimer, the term of this patent is extended or adjusted under 35 U.S.C. 154(b) by 443 days.

(21) Appl. No.: 11/922,972

(22) PCT Filed: Jun. 29, 2006

(86) PCT No.: PCT/EP2006/063689

§ 371 (c)(1),
(2), (4) Date: Feb. 18, 2009

(87) PCT Pub. No.: WO2007/003575

PCT Pub. Date: Jan. 11, 2007

(65) Prior Publication Data

US 2009/0172961 A1 Jul. 9, 2009

(30) Foreign Application Priority Data

Jun. 30, 2005 (FR) ..... 05 51847

(51) Int. Cl.
*G21F 5/012* (2006.01)

(52) U.S. Cl. ..... 33/502; 40/914; 376/261; 116/200; 116/DIG. 1

(58) Field of Classification Search ..... 33/502; 376/260, 261, 272; 40/459, 460, 914; 116/200, 116/201, 280, 284, 285, 296, 297, 303, 305, 116/307, DIG. 1; 70/432, 438, 441, DIG. 59
See application file for complete search history.

(56) References Cited

U.S. PATENT DOCUMENTS

| | | | | |
|---|---|---|---|---|
| 4,077,840 | A * | 3/1978 | Aubert | 376/463 |
| 4,678,620 | A * | 7/1987 | Marshall et al. | 376/203 |
| 5,064,606 | A * | 11/1991 | Go | 376/261 |
| 5,461,647 | A * | 10/1995 | Clark et al. | 376/260 |
| 6,134,290 | A | 10/2000 | Yoshizawa et al. | 376/272 |

FOREIGN PATENT DOCUMENTS

| | | |
|---|---|---|
| DE | 18 16 856 A1 | 7/1970 |
| EP | 0 506 512 | 9/1992 |
| FR | 2 833 401 A | 6/2003 |

OTHER PUBLICATIONS

International Preliminary Search Report, PCT/EP2006/063689, dated Jun. 29, 2006.

* cited by examiner

*Primary Examiner* — Amy Cohen Johnson
(74) *Attorney, Agent, or Firm* — Nixon Peabody LLP

(57) ABSTRACT

The invention relates to a monitoring device (20) of the position of an assembly containing nuclear fuel (4) in a housing of a storage basket (2). According to the invention, it comprises at least one mobile stop device (24, 26, 28) and a position indicator (30) suitable for being held at a stop by the mobile stop device in a first position indicating that the assembly occupies a first position, said mobile stop device being arranged so as to be able to be placed, by means of contact with the assembly located in a second position in its housing, in a position enabling it to release the position indicator devised to move automatically from the first position to a second position indicating that the assembly occupies the second position.

15 Claims, 13 Drawing Sheets

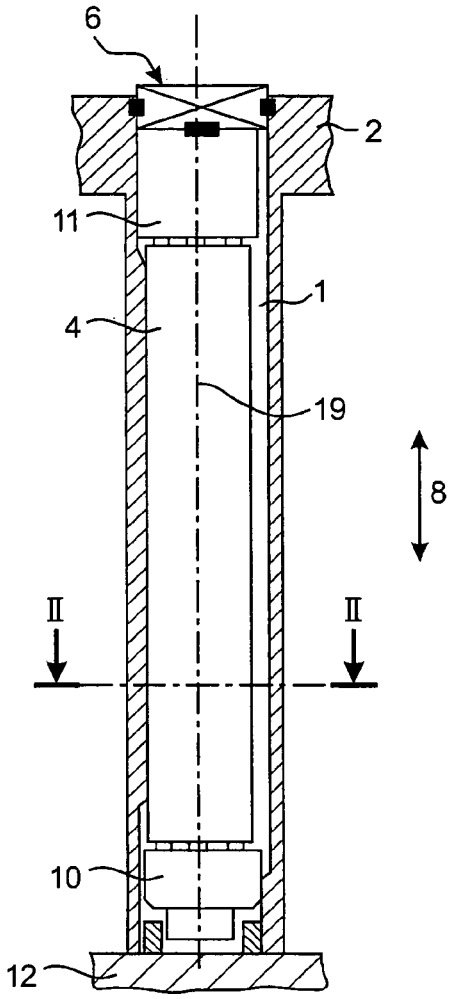
FIG.1
FIG.2
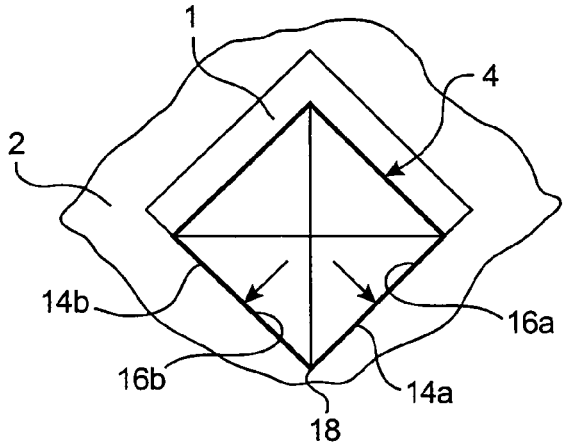

DEVICE TO MONITOR THE POSITION OF AN ASSEMBLY CONTAINING NUCLEAR FUEL IN A STORAGE BASKET HOUSING

CROSS REFERENCE TO RELATED APPLICATIONS OR PRIORITY CLAIM

This application is a national phase of International Application No. PCT/EP2006/063689 entitled "Device to Monitor the Postiion of An Assembly Containing Nuclear Fuel in a Storage Basket Housing", which was filed on Jun. 29, 2006, which was not published in English, and which claims priority of French Patent Application No. 05 51847, filed Jun. 30, 2005.

1. Field of the Invention

The present invention relates generally to a device to monitor the position of an assembly containing nuclear fuel, in a storage basket housing.

It particularly applies to the monitoring of the position of nuclear fuel assemblies or fuel rod boxes in their respective housings, said fuel rod boxes corresponding generally to metal boxes wherein nuclear fuel rods are packaged, intended for the production of fuel assemblies.

The invention also relates to a locking system of an assembly containing nuclear fuel in a storage basket housing, the system ensuring axial and lateral locking of the assembly in the housing, and being equipped with such a monitoring device.

2. State of the Related Art

During the transport of fresh nuclear fuel, for example of the "MOX" type, the containers used are arranged in the prone position, i.e. positioned horizontally, such that the nuclear fuel assemblies arranged inside the basket housings rest gravitationally on the side wall of their respective housings.

More specifically, if the assemblies are nuclear fuel assemblies of a parallelepipedic rectangle shape, they are therefore two adjacent lateral surfaces of each assembly resting respectively on two surfaces of the side wall of the housing in question. This particular arrangement is essentially adopted in order to maintain the integrity of the fuel during transport.

In the prior art, it has been proposed to reinforce the locking of these assemblies by providing a locking system fitted at the upper end of each housing. In this way, this locking system makes it possible not only to press the two lateral surfaces of the assembly flat against the side wall of the associated housing, but also makes it possible to carry out axial tightening of said assembly in its housing.

Such a system is particularly disclosed in the document FR-A-2 833 401. As an indication, it is noted that this type of tightening system cooperates in a manner with the assembly such that the latter is displaced axially towards the top of the housing during the tightening operation, which implies that this assembly is no longer in contact with the bottom of the housing during transport, but in surface contact with the locking system. The gap between the bottom of the housing and the lower tip of the assembly advantageously allows a risk-free differential expansion between these two components.

Therefore, while the addition of this locking system makes it possible to reinforce the locking of the nuclear fuel assembly in its associated housing, and reduce as a result the risks of damage of the fuel assemblies during transport, it is however noted that visual and manual access inside the housing becomes extremely restricted once the blocking system is positioned on the open end of the housing.

In this way, it remains very difficult for an operator to determine the actual position of the assembly inside its housing rapidly, this drawback being all the more restricting as the exposure time of an operator in a nuclear environment must naturally be reduced to a minimum.

As an indication, it is possible to mention various situations wherein the operator should, even if it proves to be impossible due to the presence of the station locking system above the housing to be able to monitor the position of the assembly easily and quickly.

This consists first of all naturally of the case wherein the operations for the loading of the assembly in its housing and tightening of the locking system have just been completed. In fact, the operator should be able to ensure that the assembly occupies a good position in its housing, i.e. a position enabling the transport of the container. As indicated by the above, it would be necessary to be able to monitor the satisfactory position of each of the two adjacent lateral faces of the assembly intended to be in contact with the side wall of the housing, and the position of the upper tip intended to be in surface contact with the locking system.

Another situation wherein the operator would benefit from being rapidly and easily informed of the actual position of the assembly in its housing relates to the time following the release of the locking system. In fact, after the transport of the container and before removing the locking system, the operator should be able to ensure that the fuel assembly occupies a position enabling the unloading thereof from the housing, i.e. a position that can be qualified as "unlocked" and conveying, on one hand, the fact that the locking system has been sufficiently unlocked to be able to be removed from the housing without any risk of damage to the assembly, and, on the other, the fact that the latter has returned to rest in the bottom of the housing, or in a position very close to said bottom.

As indicated by the above, given that the release of the locking system results, in some types of embodiment, in an axial movement of the assembly to the bottom of the housing to the point of unloading said assembly in the bottom of the housing, it would be sufficient in this case to be able to monitor the axial positioning of said assembly.

OBJECT OF THE INVENTION

Therefore, the aim of the invention is to propose a device to monitor the position of an assembly containing nuclear fuel in a storage basket housing, and a locking system of an assembly incorporating such a monitoring device, so as to remedy at least partially the drawbacks mentioned above relating to embodiments according to the prior art.

To this end, the invention relates to a device to monitor the position of an assembly containing nuclear fuel in a storage basket housing, comprising at least one mobile stop device and a position indicator suitable for being held at a stop by the mobile stop device in a first position indicating that the assembly occupies a first position, said mobile stop device being arranged so as to be able to be placed, by means of contact with the assembly located in a second position in its housing, in a position enabling it to release the position indicator devised to move automatically from the first position to a second position indicating that the assembly occupies the second position.

Advantageously, said monitoring device of a simple and clever design makes it possible to inform the operator rapidly and clearly on the position of the assembly in its housing, without it being necessary to have visual or manual access to the inside of said housing. In fact, the position indicator may easily be mounted outside the housing in question, such as the storage basket, or preferentially on the locking system fitted in the upper part of said housing. In this case, this indicator is produced so as to generate clear information for the operator, such as digital type information.

It is also noted that the result of the presence of such a device for each basket housing is that the exposure time of the operator in the nuclear environment during the loading and unloading of the assemblies may advantageously be substantially reduced.

Preferentially, the device is designed such that said first position of the assembly corresponds to a position prohibiting transport, and designed such that the second position of the assembly corresponds to a position enabling transport and such that the second position of the indicator corresponds to a position indication position enabling transport.

In such a case, it is therefore necessary to understand that the monitoring device makes it possible to indicate generally to the operator, following the loading of the assembly in housing and after the tightening of the locking system, whether the assembly occupies a satisfactory position in its housing, i.e. a satisfactory position with a view to subsequent secure transport of the container. As detailed hereinafter, it is noted that the position enabling transport is obtained when the assembly has made all the required contacts with the housing and the locking system, when such a system has been provided.

It is also possible to envisage that the position indicator is also suitable for being held at a stop by at least one mobile stop device in the position indication position enabling transport, said mobile stop device being arranged so as to be able to be placed, by means of contact with the assembly located in a position enabling the unloading thereof from the housing, in a position enabling it to release the indicator designed to move automatically from the position indication position enabling transport, to a position indication position enabling the unloading of the assembly.

In this way, in this configuration enabling the monitoring device to indicate a third position, the operator may then be informed, before unloading the assembly and after the release of the locking system, whether the assembly occupies a position or not enabling a risk-free extraction of the locking system, this extraction needing necessarily to be performed before the unloading of the assembly. As detailed hereinafter, it is possible to envisage that the position enabling the unloading of the assembly is obtained when the assembly was replaced in the bottom of the housing or returned in the vicinity thereof, following the release of the locking system.

In addition, it is preferentially envisaged that the indicator is held at a stop in the position indication position enabling transport by a single mobile stop device, preferentially any of those already used to maintain said indicator in the position indication position prohibiting transport.

Alternatively, the monitoring device may be designed such that the first position of the assembly corresponds to a position prohibiting the unloading of the assembly and such that the first position of the indicator corresponds to a position indication position prohibiting the unloading of the assembly, and designed such that the second position of the assembly corresponds to a position enabling the unloading thereof from the housing and such that the second indicator position corresponds to a position indication position enabling the unloading of the assembly.

Therefore, in this case where the device is not intended to provide information on the position of the assembly before the transport of the container, but only generally devised to monitor the unloading of assembly at the bottom on the housing after the release of the locking system, therefore, it is possible to envisage only monitoring the axial position of the assembly with this device, for example using a single mobile stop device, such as an axial thruster. As an indication, it is noted that the change of the assembly from the position prohibiting unloading to the position enabling unloading is identical or similar to the abovementioned change from the position enabling transport to the position enabling unloading, as in both cases, the assembly changes from a state wherein it is at a distance from the bottom of the housing to a state wherein it is in contact with said bottom or very close thereto.

Preferentially, the device comprises a plurality of mobile stop devices, each suitable for holding the position indicator at a stop in the first position. In addition, as mentioned above, it is also possible to envisage that at least one of these devices is suitable for holding the indicator in at least one other position among those specified above.

In this case, the device comprises a first mobile stop device arranged to move in translation in a first direction, said first device preferentially taking the form of a thruster provided with a throat cooperating with a groove produced in the position indicator.

According to a first preferred embodiment of the present invention, the device also comprises a second mobile stop device and a third mobile stop device respectively arranged to pivot around a second direction and a third direction, the first, second and third directions being orthogonal with respect to each other.

In this way, the three devices proposed make it possible to monitor the position of three orthogonal surfaces of the assembly, by means of contact therewith, this solution being evidently sought in order to monitor the position of rectangle parallelepipedic shaped assemblies, such as that observed on nuclear fuel rod assemblies and fuel rod boxes. Naturally, the invention also applies to the monitoring of the position of assemblies displaying a different shape, the number and design of the mobile stop devices then being selected as a function of the number and layout of the surfaces of the assembly to be monitored.

Preferentially, the first, second and third mobile stop devices are equipped with elastic return means, which preferentially all tend to return their associated mobile device to a position wherein the latter forms a stop for the indicator.

According to a second preferred embodiment of the present invention, the monitoring device no longer incorporates the second and third abovementioned devices, but comprises a fourth mobile stop device arranged to move in translation along a first direction, said fourth mobile stop device having one contact end of a tapered shape, of an axis parallel with the first direction.

In this way, said contact end of tapered shape makes it possible to monitor the position of two surfaces of the assembly orthogonal with each other and parallel with the first direction, whereas the first device makes it possible to monitor the position of a third surface of said assembly, orthogonal with the two others. The second preferred embodiment, wherein the fourth mobile stop device is equipped with elastic return means, is therefore also particularly suitable for monitoring the positioning of assemblies of rectangle parallelepipedic shape, but could naturally find an application for assemblies having other shapes.

Moreover, the position indicator takes the form of a flap equipped with elastic return means enabling the automatic movements thereof from the first position to the second position.

Finally, the invention also relates to a locking system of an assembly containing nuclear fuel in a storage basket housing, said system providing axial and lateral support of the assembly in its housing, and being equipped with a monitoring device such as that described above and also according to the present invention. As described above, the lateral support is preferentially performed by pressing at least two surfaces of the assembly against the associated housing, and preferentially two surface orthogonal with each other.

Other advantages and characteristics of the invention will emerge in the non-limitative detailed description below.

BRIEF DESCRIPTION OF FIGURES

This description with be made with reference to the appended figures wherein;

FIG. 1 represents a schematic and partial sectional view of a storage basket housing wherein a nuclear fuel assembly is located, the housing being equipped with a locking system according to the present invention, shown in a tightening configuration wherein it locks the assembly in its housing;

FIG. 2 represents a sectional view along line II-II in FIG. 1;

DETAILED DESCRIPTION OF PREFERRED EMBODIMENTS

Figure 3:
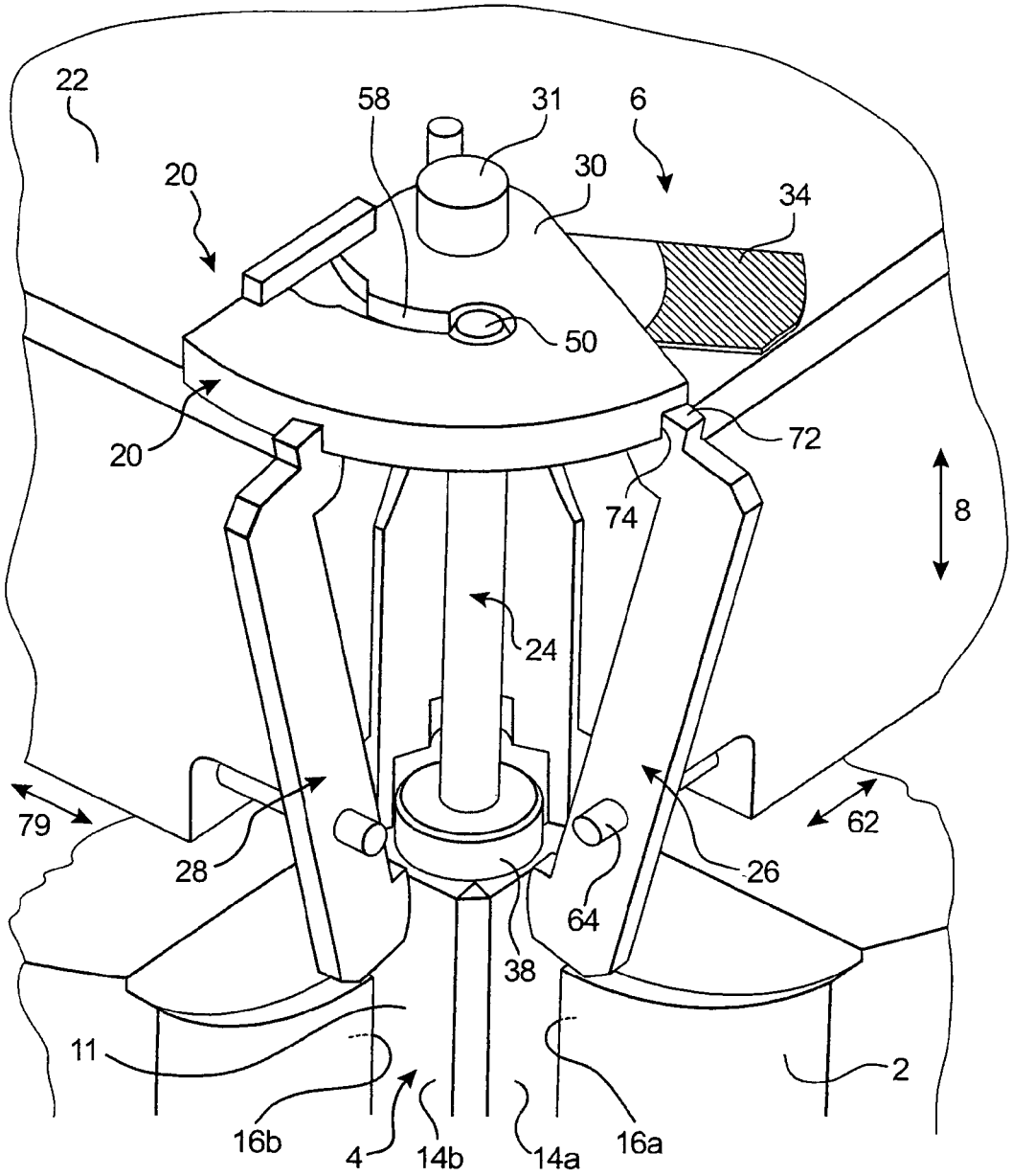
FIG. 3 represents a partial perspective view of the locking system, comprising a position monitoring device of the fuel assembly in its housing according to a first preferred embodiment of the present invention, said monitoring device being located in a configuration wherein the position of the assembly in its housing is such that transport is prohibited.

With reference to FIG. 1, a housing 1 of a storage basket 2 can be seen, wherein a nuclear fuel assembly 4 is located. As an indication, it is noted that one or more housings 1 may be provided in the basket 2 intended to be arranged in a container (not shown), without leaving the scope of the invention.

Each housing 1 is designed to receive only one assembly 4. To this end, the inner dimensions of the housing 1 are slightly greater than those of the assembly 4, as can be seen clearly in FIG. 1. In addition, the fuel assemblies 4 and the housings 1 generally have polygonal complementary cross sections, generally square as illustrated schematically in FIG. 2.

Housing 1 is equipped on the upper open part thereof with a locking system 6 according to the present invention, shown only schematically and in a tightening configuration wherein it locks the assembly 4 in its housing 1, which was previously inserted therein.

The tightening performed by means of the system 6 makes it possible to lock the assembly 4 along the axial direction 8 of the housing 1, by means of surface contact, preferentially plane, between an upper tip 11 of the assembly and said blocking system, and more preferentially between the horizontal upper surface 9 of the upper tip 11 and the locking system. In a manner known to those skilled in the art, the tightening operation results in the detachment of the lower tip 10 of the assembly from the bottom 12 of the housing 1, as can be seen in FIG. 1, which enables the differential expansion between both components.

In addition, in the general case wherein the assembly 4 has a square cross section, the tightening being performed on the upper tip 11 of the assembly 4 also results in causing the pressing of two adjacent lateral faces 14*a*, 14*b* of said assembly 4 against two adjacent lateral surfaces 16*a*, 16*b* respectively of the lateral wall of the housing 1, as can be seen schematically in FIG. 2. In addition, it is noted that this locking, referred to as lateral locking, is jointly provided during the transport of the assemblies 4 by the specific position of the container, referred to as prone or horizontal. In this position represented in FIG. 2, the axial direction 8 of the housing 1 is parallel with the floor, and the edge 18 attaching the two orthogonal lateral surfaces 16*a*, 16*b* corresponds to the lowest part of the housing 1, such that both surfaces 16*a*, 16*b* jointly form an upward opening V. As a result, both surfaces 14*a*, 14*b* of the assembly 4 tend, under the effect of gravity, to press against the surfaces 16*a*, 16*b* respectively during the transport. As described above, the two-plane lateral contact is sought in order to retain the integrity of the fuel during transport. It is nevertheless reminded that during the loading and unloading of the assemblies 4, the container is generally oriented such that the longitudinal axis 19 of each housing 1, parallel with the direction 8, is substantially vertical.

The design of the locking system 6, and more specifically that of its means making it possible to carry out the three lockings described above, corresponds to a design known to those skilled in the art, and will therefore not be described further. As an indication, said locking system 6 designed to limit the movements of the assembly 4 during transport as much as possible may take any of the forms described in the document FR-A-2 833 401, which is incorporated herein by reference. In these various forms, the system essentially comprises an attachment device designed to produce a rigid connection between the upper tip of the assembly, and the open end of the housing.

As will now be described, the specificity of this system 6 lies in the fact that it incorporates a position monitoring device of the assembly in the housing in question.

Firstly with reference to FIG. 3 representing a monitoring device 20 according to a first preferred embodiment of the present invention and fitted in the locking system 6, it can be seen that said device 20 is preferentially located at a corner of the system 6 of substantially square cross section (the end of the corner at which the device 20, which has been voluntarily omitted for clarity reasons, is located). In this case, it should be understood that the main plate 22 of the system 6, which substantially seals the open end of the housing 1 and which also serves as the sealing flange, serves as an assembly support for the monitoring device 20.

In this FIG. 3, the device 20 is represented in a configuration wherein the position of the assembly 4 in its housing 1 is such that transport is prohibited, this state being encountered particularly when the assembly 4 has just been loaded in the housing 1 but the tightening of the locking system 6 has not been performed, or when the tightening has been performed but the assembly 4 occupies, due to an anomaly of any kind, a different final position to that required. Moreover, this state may also be encountered prior to the loading of the assembly 4 in the housing 1.

As an indication, FIG. 3 shows a partial view of the assembly 4 in a position corresponding to that occupied directly after the loading thereof and before the tightening of the system 6, wherein it is resting on the bottom of the housing 1.

As will be explained hereinafter, the monitoring device 20 is preferentially designed to monitor the axial position of the assembly, and its lateral position in two separate directions, which are in this case orthogonal due to the orthogonal nature between the two lateral surfaces 14*a*, 14*b* wherein the contact with the wall of the housing 1 is to be monitored.

For this purpose, it comprises two mobile stop devices 24, 26, 28, which, when the assembly 4 occupies a position prohibiting transport in its housing, each hold via a stop a position indicator 30 in a position indication position prohibiting transport.

Said position indicator 30 may be made in any manner known to those skilled in the art, by combining it with marking made on a support of the indicator which in this case is the plate 22, said marking possibly for example taking the form of a graduation, and more generally any form enabling the operator to be able to determine visually the position of the indicator, and therefore that of the assembly in the housing. For example, in the first preferred embodiment represented in the figures, the indicator takes the form of a flap 30 mounted externally in a hinged manner on the main plate 22 serving as a support, along a pivot 31 parallel with the axial direction 8. In this position indication position prohibiting transport, its angular position with respect to the plate 22 is such that it reveals a first zone 34 of a marking, said zone 34 being produced on the upper surface of said plate 22 and created so as to indicate clearly and accurately to the operator that the assembly 4 is incorrectly positioned in the housing 1 to which it no longer has visual access. This first zone 34 may for example adopt a specific colour, belonging to a colour code known to the operator.

Figure 4A:
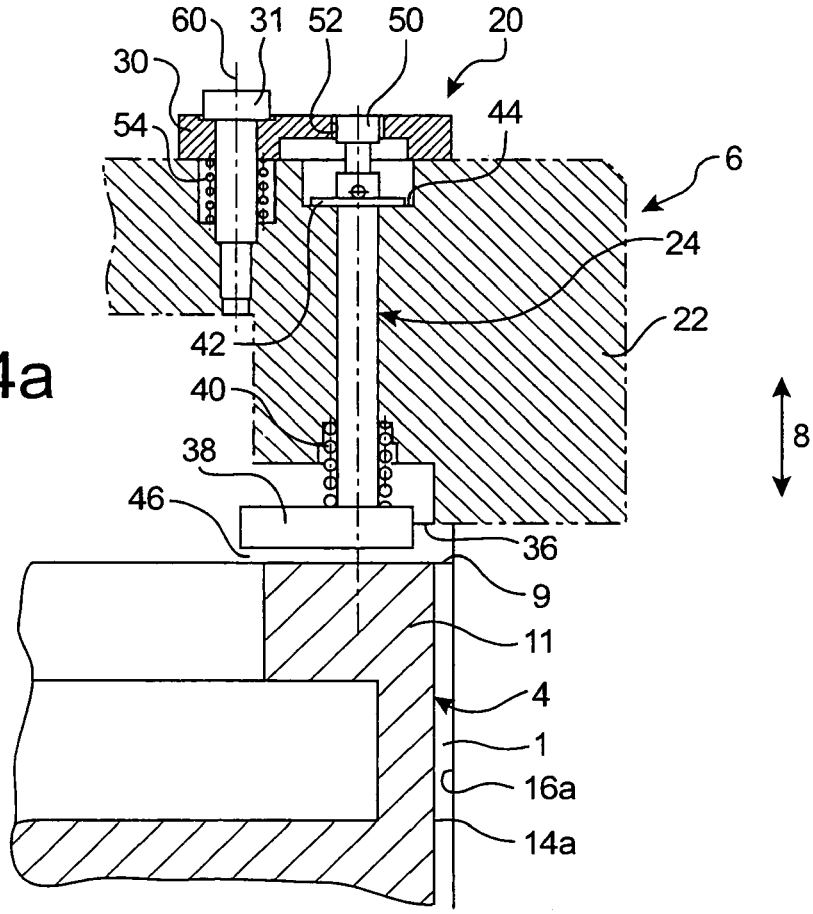
FIG. 4*a* shows a partial sectional view showing more specifically the first mobile stop device of the device shown in FIG. 3.

More specifically with reference to the FIG. 4*a* showing the first mobile stop device 24, it can be seen that said device takes the form of a thruster oriented in the direction 8 and wherein one lower end 38 is close to the tip of square cross section 11 of the assembly resting in the bottom of the housing 1.

At this stage, the locking system 6 has only been positioned on the upper part of the housing 1 with which it is in contact, but it has not yet been tightened. This is the reason for which the assembly 4 occupies an axial position prohibiting transport, which is conveyed by the absence of contact between the upper surface 9 of the tip 11 and a lower horizontal surface 36 of the plate 22, these two surfaces 9, 36 being oriented perpendicular with the direction 8.

Therefore, the axial thruster 24 is in the lowest position provided by elastic return means preferentially taking the form of a compression spring 40 inserted between the plate 22 and the lower end 38, and by a shoulder 42 limiting the stroke of said thruster 24 downwards by pressing against a seat 44 produced in an upper portion of the plate 22. In this position, the lower end 38 and the upper end 9 are preferentially spaced by a clearance 46. Moreover, an upper end 50 of said thruster 24 is housed in a through orifice 52 of the flap 30, the orifice 52 and the end 50 having a substantially identical diameter.

Therefore, the stop between these two components 50 and 52 makes it possible to maintain the flap 30 in the position indication position prohibiting transport shown in FIG. 3. In fact, without this stop, the flap 30 would be rotated around the axis 60 of the pivot 31 via elastic return means preferentially taking the form of a torsion spring 54 arranged around the pivot 31, in turn passing through the flap 30 and being arranged in the direction 8. In this case, the spring 54 has a lower end attached to the plate 22 and an upper end attached to the flap 30.

Figure 4B:
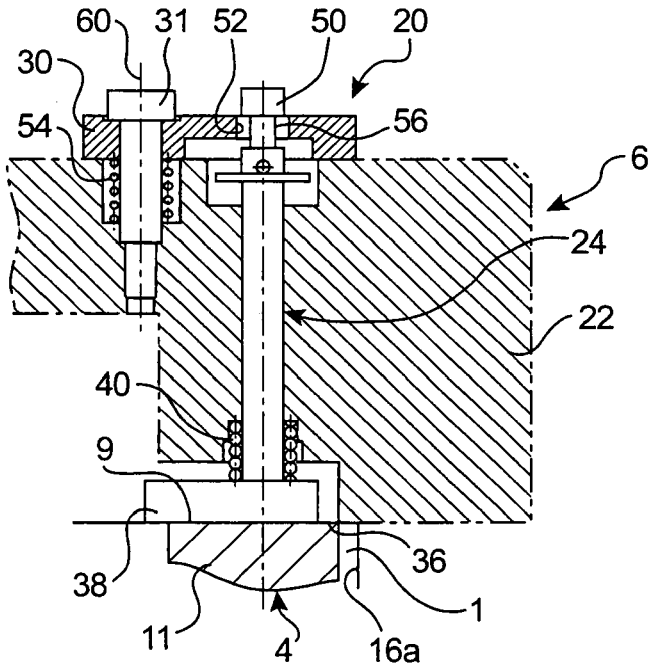
FIG. 4*b* shows a similar view to that of FIG. 4*a*, in a configuration wherein the axial position of the assembly in its housing is satisfactory.

With reference now to FIG. 4*b* showing a partial view of the device 20 in a configuration wherein the axial position of the assembly 4 in its housing 1 is satisfactory, it can indeed be seen that said assembly has been sufficiently tightened by the locking system 6 so that sufficient pressure of the surface 9 of the upper tip 11 is induced against the lower surface 36 of the plate 22.

During this tightening, the upward movement of the assembly 4 in the housing 1 results in the surface 9 and the lower end 38 of the thruster 24 coming into contact. As a result, the tip 11 applies an action on the thruster 24 which is then moved upwards compressing the spring 40, until the surfaces 9 and 36 come to a stop, as is represented in FIG. 4*b*. In this position, it can be seen that the thruster 24 has been moved sufficiently upwards so that the end 50 thereof is fully extracted from the orifice 52, which is now facing a throat 56 of said thruster, and located below the end 50.

The diameter of said throat 56 is substantially identical to the width of a groove 58 (visible in FIG. 3) taking the form of an arc of a circle centered on the axis 60 of the pivot 31, and opening into the abovementioned orifice 52. In this way, in this state, the thruster 24 no longer holds the flap 30 at a stop, as a pivoting thereof along the axis 60 would result in an engagement of the circular groove 58 in the throat 56, and a relative sliding between these two components 56, 58.

Figure 5B:
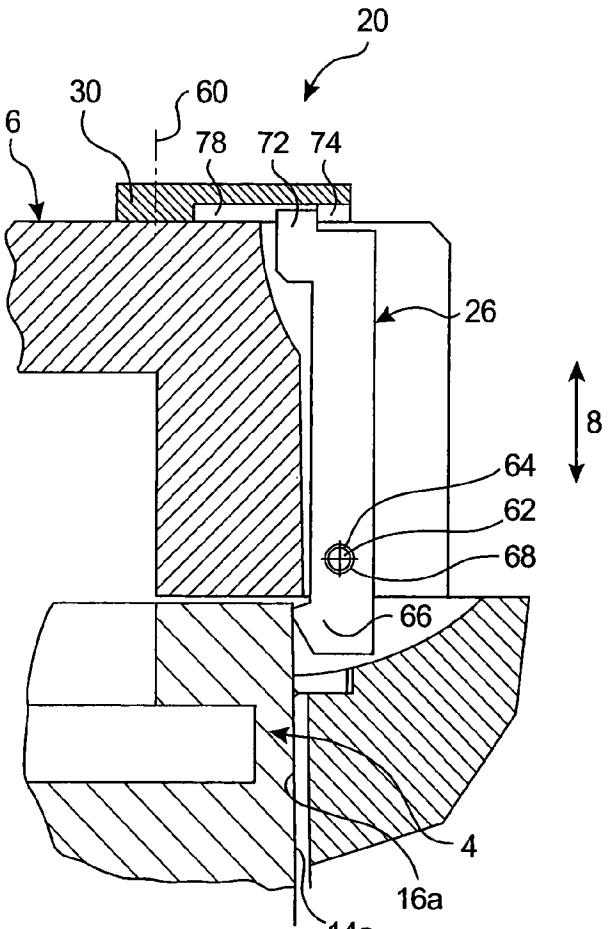
FIG. 5*b* shows a similar view to that in FIG. 5*a*, in a configuration wherein the lateral position of the assembly in its housing is satisfactory.
Figure 5A:
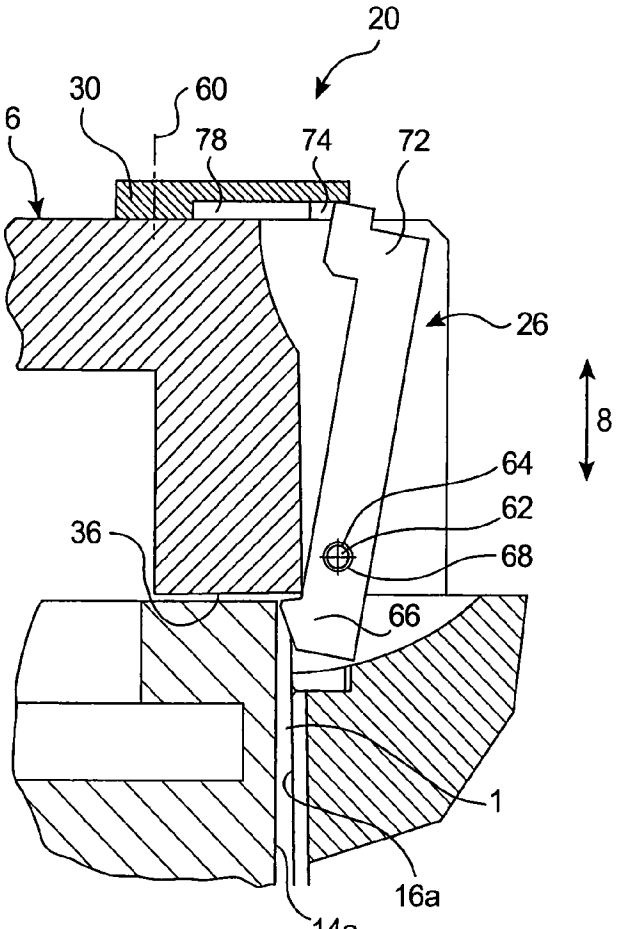
FIG. 5*a* shows a partial sectional view showing more specifically the second mobile stop device shown in FIG. 3.

With reference now to FIG. 5*a* showing the second mobile stop device 26, it can be seen that said device takes the form of an arm arranged in a hinged manner around a pivot 64 extending in a second direction 62 orthogonal to the direction 8, said direction 62 also being parallel with the surface 16*a* of the housing 1.

At this stage, the locking system 6 has only been positioned on the upper part of the housing 1 with which it is in contact, but it has not yet been tightened. This is the reason for which the assembly 4 occupies a lateral position prohibiting transport, which is conveyed by the absence of contact between the lateral surface 14*a* of the assembly and the lateral surface 16*a* of the housing.

Therefore, the arm 26 is in a position wherein its lower end projects more inside the housing 1, via the surface 16*a*, this position being held by default by means of elastic return means such as a torsion spring 68 only represented schematically and being arranged around the pivot 64, therefore in the second direction 62. In this case, the spring 68 has one end attached to the arm 26, and another end attached to the plate 22. In this way, as is also the case for the spring 40 associated with the thruster 24, the spring 68 holds the arm 26 in a stop position for the flap 30.

Therefore, in this state held by the stop between the surface 36 of the plate 22 and the lower end 66 of the arm 26, this arm 26 rests in a substantially tilted position wherein it deviates upwards from the housing.

Moreover, an upper end 72 of said arm 26, also referred to as the stop end, is housed in a straight groove 74 of the flap 30, said groove 74 opening radially to the outside of said flap 30 and being created on a lower surface thereof. More specifically, the groove 74 is created in the same plane as the plane of movement of the arm 26, i.e. in a plane parallel with the direction 8 and orthogonal with the direction 62.

Therefore, here again, the stop between these two components 72, 74 makes it possible to hold the flap 30 in the position indication position prohibiting transport shown in FIG. 3. In fact, without this stop, the flap 30 would be rotated around the axis 60 of the pivot 31 via the torsion spring 54 already described.

With reference now to FIG. 5*b* showing a partial view of the device 20 in a configuration wherein the lateral position of the assembly 4 in its housing 1 is satisfactory, it can be seen that this assembly has been sufficiently tightened by the locking system 6 so that sufficient pressure of the lateral surface 14*a* of the assembly 4 is induced against the lateral surface 16*a* of the housing 1.

During this tightening, the lateral movement of the assembly 4 in the housing 1, in the direction of the surface 16*a*, results in the surface 14*a* and the lower end 66 of the arm 26 coming into contact. As a result, the surface 14*a* exerts an action on the arm 26 which pivots around the pivot 64 in the second direction 62 by compressing the spring 68, until the surfaces 14*a*, 16*a* come to a stop, as represented in FIG. 5*b*. In this position where the upper end 72 of the arm 26 has been returned to the housing 1 and the lower end 66 pushed outside said housing, it can be seen that the end 72 has been moved sufficiently to be fully extracted from the groove 74. In fact, the upper stop end 72 is now in a gap 78 created on the lower surface of the flap 30, this gap 78 being arranged radially more towards the inside with respect to the groove 74.

In this way, in this state, the arm 26 no longer holds the flap 30 at a stop, as a pivoting thereof along the axis 60 would result in a relative movement between the gap 78 and the end 72 located therein.

With reference again to FIG. 3, it can be seen that the design of the third mobile stop device 28 is identical to that of the second described above, and, as a result, it will not be described any further. However, this third device 28 is provided to monitor the contact between the surfaces 14*b* and 16*b*, and therefore its pivoting arm is arranged so as to be able to be rotated in a third direction 79 orthogonal to the first and second directions 8 and 62. As such, it is noted that when the contact is made between these two lateral surfaces 14*b*, 16*b*, the upper end of the arm 28 incorporates the gap 78 after being extracted from its associated groove.

Figure 6:
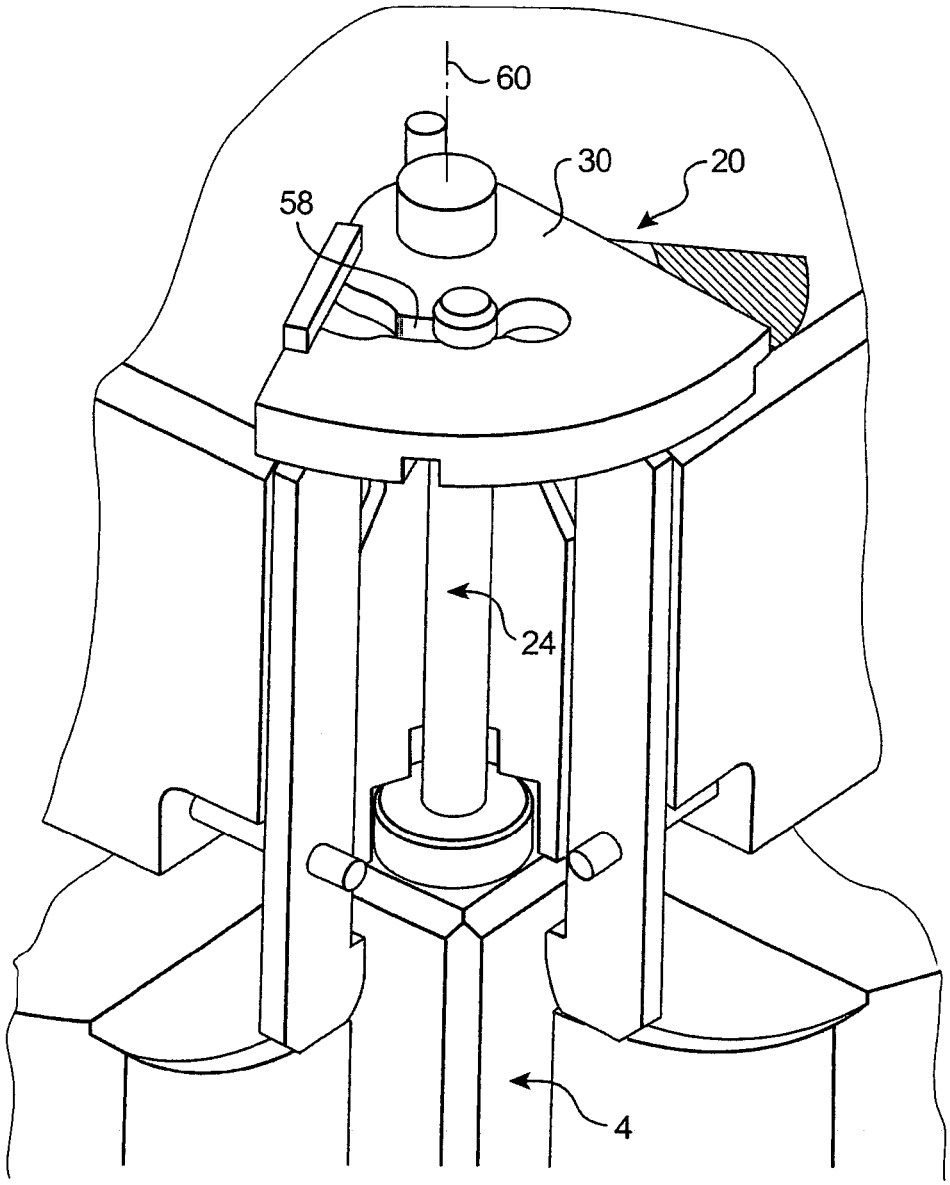
FIG. 6 represents a similar view to that in FIG. 3, the monitoring device being located in a configuration encountered during the automatic movement of its position indicator between the position indication position prohibiting transport, and the position indication position enabling transport.

At the end of the tightening of the locking system 6, the three mobile stop devices 24, 26, 28 are normally positioned simultaneously in the states shown in FIGS. 4*b* and 5*b* respectively wherein they no longer hold the flap 30 at a stop, these three satisfactory states being obtained in any order. Therefore, from this time only, the free flap 30 is only subjected to the action of the torsion spring 54 which causes a pivoting of the latter around the axis 60, during which the groove 56 slides in the circular groove 58 as shown in FIG. 6.

Figure 7:
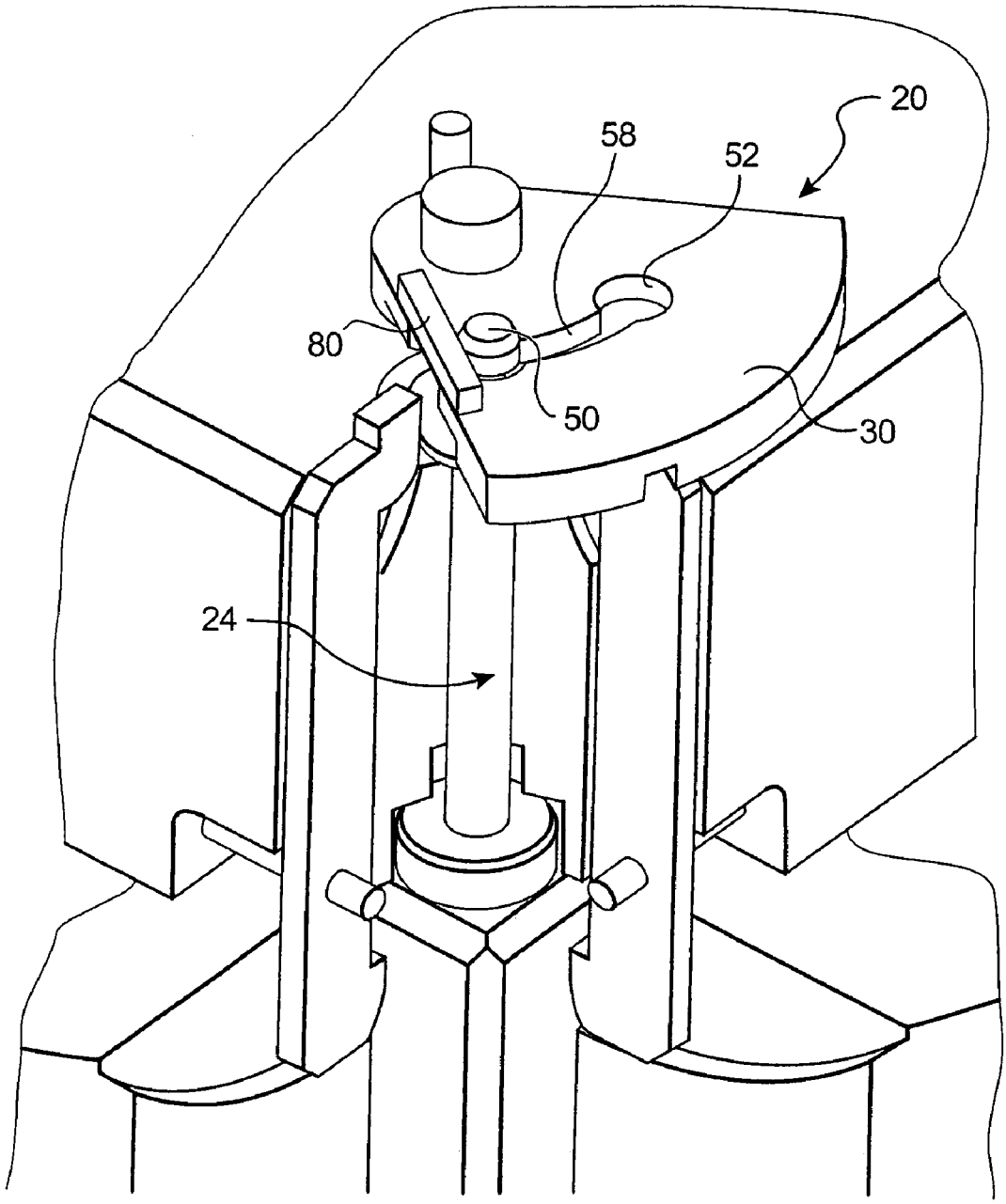
FIG. 7 represents a similar view to that shown in FIG. 3, the monitoring device being located in a configuration wherein the position of the assembly in its housing is such that transport is enabled.
Figure 8:
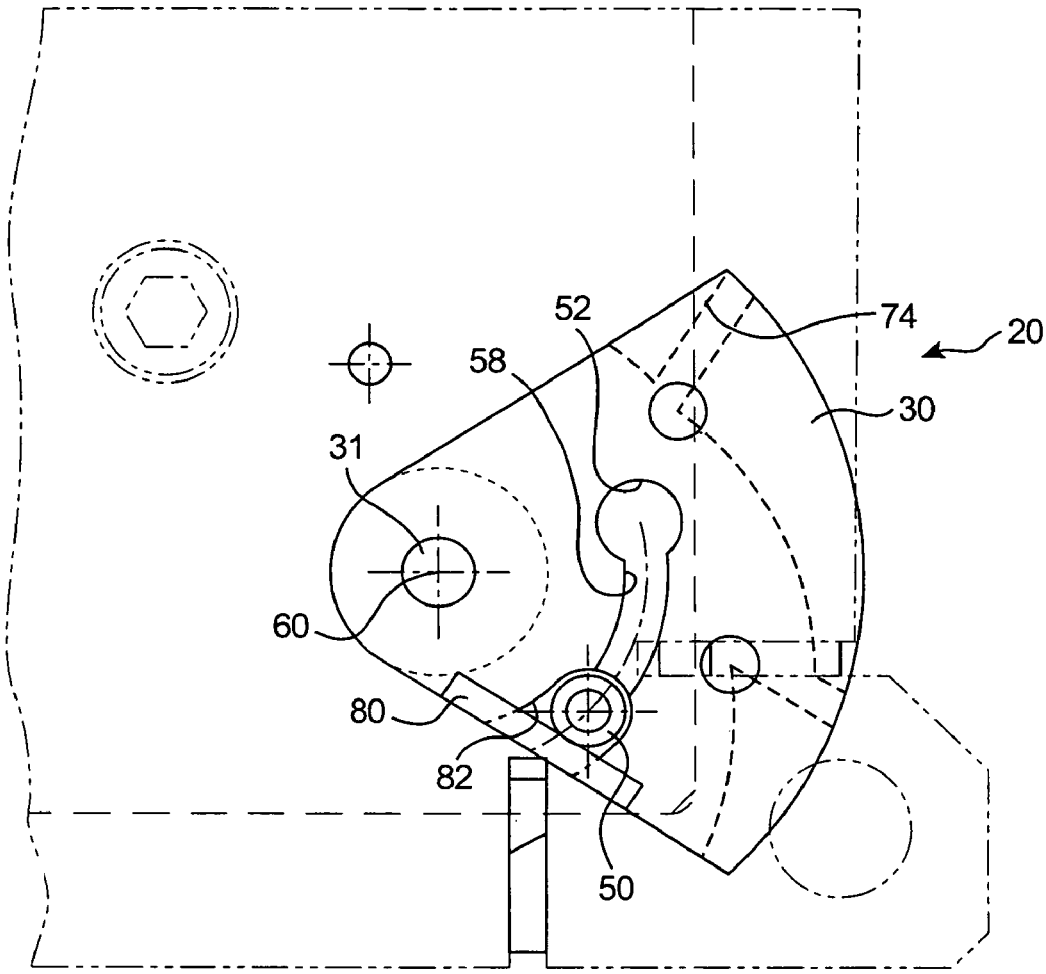
FIG. 8 represents a top view of FIG. 7.

Jointly with reference to FIGS. 7 and 8 showing the monitoring device 20 located in a configuration wherein the position of the assembly in its housing is such that transport is enabled, it can be seen that the flap 30 having been moved automatically under the effect of the spring 54 is stopped in a specific angular position by a stop between the upper end 50 of the thruster 24, and a tab 80 located above the through groove 58, on the upper surface of the flap 30. More specifically, this tab 80 is arranged above an outlet section 82 of the groove 58, this section 82 being opposite the end of the groove opening into the orifice 52, and having a width greater than that of the rest of said groove.

In this position indication position enabling transport, the angular position of the flap 30 with respect to the plate 22 is such that it covers the first marking zone 34, which indicates clearly and precisely to the operator that the assembly 4 is positioned correctly in the housing 1 to which he no longer has visual access. In this preferred example of marking, it was indeed envisaged that during the occupation by the flap 30 of the position indication position enabling transport, none of the zones of the marking are displayed.

The device 20 is also devised, in this first preferred embodiment, such that the flap 30 can occupy a third position referred to as the position indication position enabling unloading of the assembly. In fact, in this third position, the operator can then be informed, before the unloading of the assembly 4 and after the release of the locking system 6, whether said assembly occupies a position or not enabling a safe extraction of the locking system 6. It can then be preferentially envisaged that the position enabling unloading of the assembly is obtained when the assembly 4 has been unloaded in the bottom of the housing or returned in the vicinity thereof, following the release of the locking system 6.

In fact, during this release, the assembly 4 is returned to the bottom of the housing 4, and, therefore, the thruster 24 forming the only mobile stop device to still hold the flap 30 follows the movement of said assembly, under the effect of the compression spring 40 undergoing decompression. As a result, said thruster 24 is lowered progressively to the position shown in FIG. 4*a*, implying that the upper end 50 thereof is lowered below the tab 80 by entering in the outlet section 82 (shown in FIG. 9) of the groove 58 wherein the width is greater than or equal to the diameter of said end 50. In this way, in this state, where the upper end 50 is entirely located below the tab 80 and where the thruster 24 is again at a stop against the seat 44, said thruster no longer holds the flap 30 at a stop, as a pivoting thereof along the axis 60 would result in relative sliding between the outlet section 82 of the groove 58, and the end 50 located therein.

Figure 9:
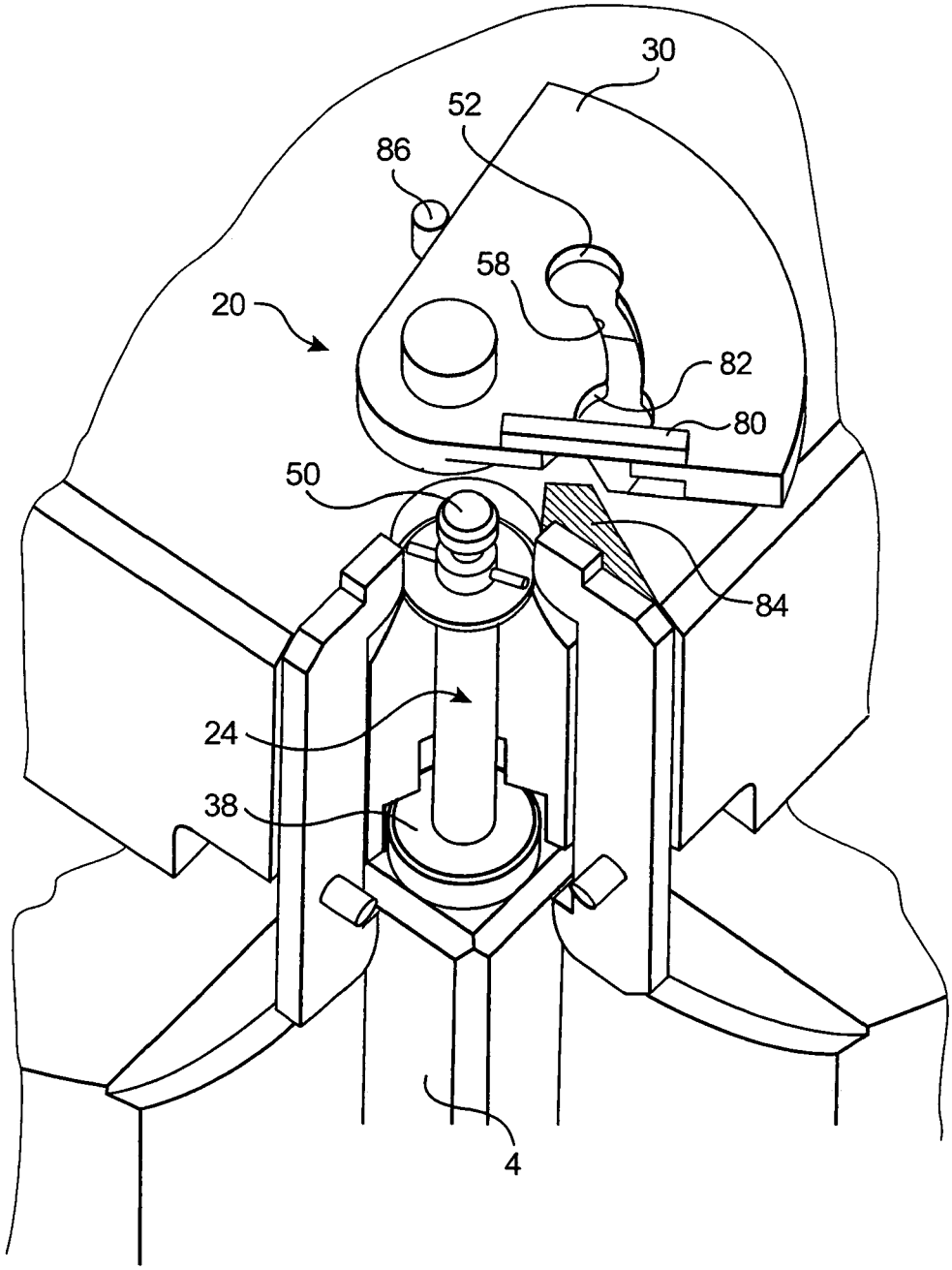
FIG. 9 represents a similar view to that shown in FIG. 3, the monitoring device being located in a configuration wherein the position of the assembly in its housing is such that the unloading thereof is enabled.

As a result, the flap 30 may then automatically reach the position indication position enabling unloading of the assembly as shown in FIG. 9, under the simple effect of the spring 54. In this position indication position, the angular position of the flap 30 with respect to the plate 22 is such that it reveals a second marking zone 84 and that it continues to cover the first zone 34, said second zone 84 also being created on the upper surface of said plate 22 and produced so as to indicate clearly and precisely to the operator that the assembly 4 is positioned correctly in the bottom of the housing 1 or in the vicinity thereof. Naturally, this second zone 84 preferentially adopts a different colour to that of the first zone 34. In addition, this third position is then kept by a stop between the flap 30 and a stud 86 provided on the upper surface of the flap 30.

As an indication, it is noted that, to prevent static indetermination problems, the automatic transition between the second and the third position of the flap 30 is performed preferentially not at the end of release, but just before the end of said release of the system 6. As a result, after the abovementioned transition of the flap 30 from the second to the third position, the operator is obliged to complete the release to finish unloading the assembly in the bottom of the housing 1, the lowering induced only however being very slight and corresponding substantially to the clearance 46 shown in FIG. 4*a*.

Once these operations have been performed, the operator can then remove the locking system 6 and extract the assembly 4 from its housing 1. In addition, the monitoring device 20 may then be reset manually with a view to a future assembly transport in the housing in question.

Figure 10:
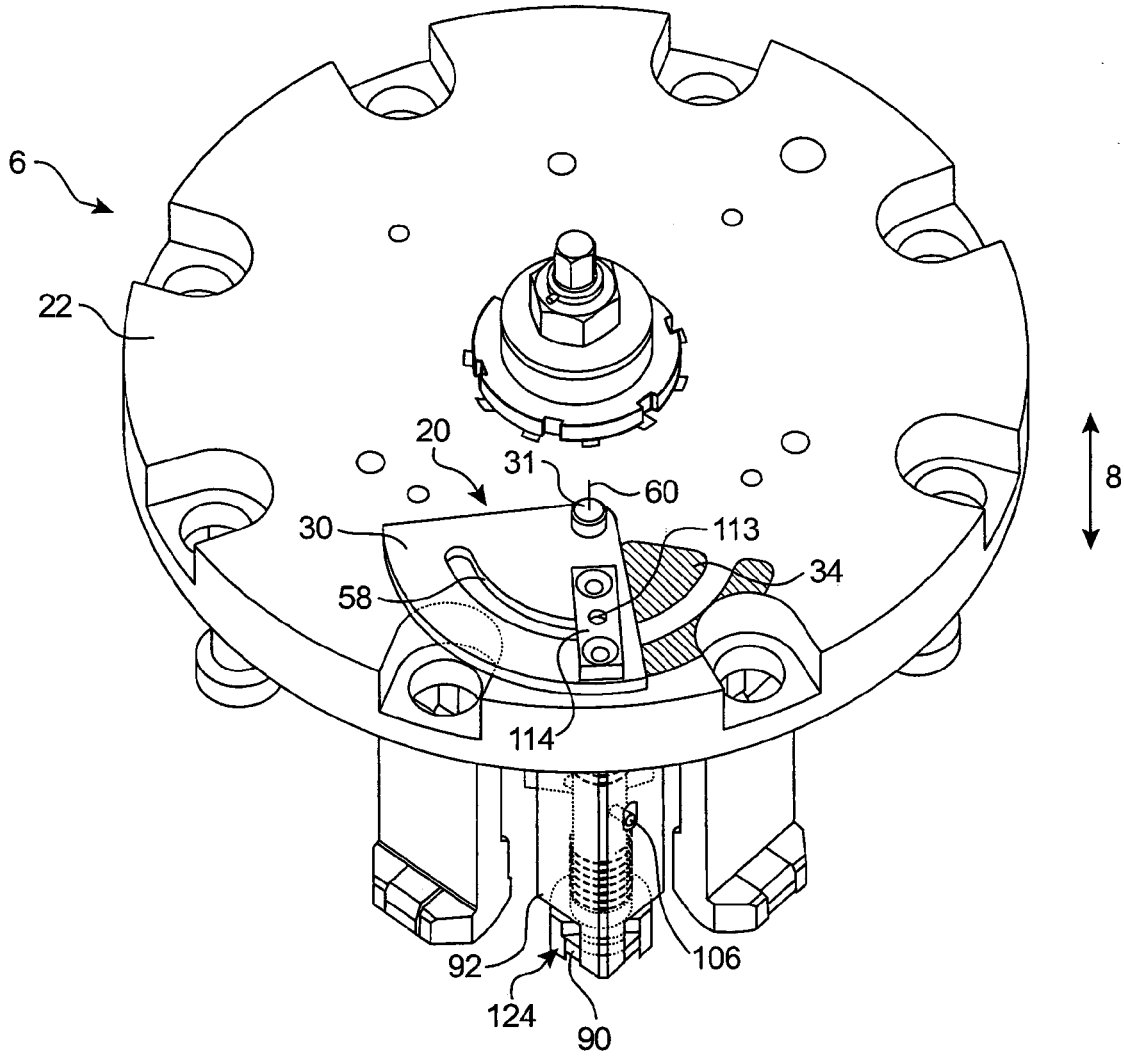
FIG. 10 represents a partial perspective view of the locking system, comprising a position monitoring device of the fuel assembly in its housing according to a second preferred embodiment of the present invention, said monitoring device being located in a configuration wherein the position of the assembly in its housing is such that transport in prohibited.

With reference now to FIG. 10, a monitoring device 20 according to a second preferred embodiment of the invention can be seen, said device being fitted in the locking system 6 also according to the present invention. It is noted that this embodiment displays similarities bearing the same numeric references in the figures corresponding to identical or similar components.

Moreover, this device will be described as being only capable of detecting two separate positions of the assembly in its housing, i.e. that prohibiting transport and that enabling the transport of said assembly. Nevertheless, it is clear that it could be adapted by those skilled in the art, in view of the first preferred embodiment described above, to also detect a third position corresponding to the position enabling unloading of the assembly.

Overall, said second embodiment differs from the first in that the two lateral arms 26 and 28 are replaced by a fourth mobile stop device taking the form of a thruster suitable for monitoring the lateral position of the assembly in the housing.

More specifically, as can be seen in FIG. 10 showing the device 20 in a configuration wherein the position of the assembly (not shown) in its housing is such that transport is prohibited, said device 20 is also located at the periphery of the system 6 of substantially square cross section and incorporating a main plate 22 designed to seal the open end of the housing.

As will be explained hereinafter, the monitoring device 20 is preferentially designed to monitor the axial position of the assembly, and its lateral position in a plane orthogonal to the axial direction 8. In this way, the monitoring of the lateral position performed, comparable to lateral monitoring in two directions, for example orthogonal with each other as was the case in the first preferred embodiment, is clearly associated with both lateral surfaces 14*a*, 14*b* of the assembly 4 wherein the contact with the wall of the housing to be monitored. As a result, said device 20 is very suitable to monitoring the contact of three orthogonal surfaces of the assembly 4, respectively with the tightening system 6 and the lateral wall of the housing.

For this purpose, it comprises a first mobile stop device 124 and a fourth mobile stop device 90, which, when the assembly 4 occupies a position prohibiting transport in its housing, hold by a stop the flap 30 in the position indication position prohibiting transport, said flap 30 being in this case also hinged around the pivot 31 of the axis 60 parallel with the direction 8. In this position indication position prohibiting transport, the angular position of the flap 30 with respect to the plate 22 is such that it reveals is the first marking zone 34 created so as to indicate clearly and precisely to the operator that the assembly 4 is incorrectly positioned in the housing.

Figure 11A:
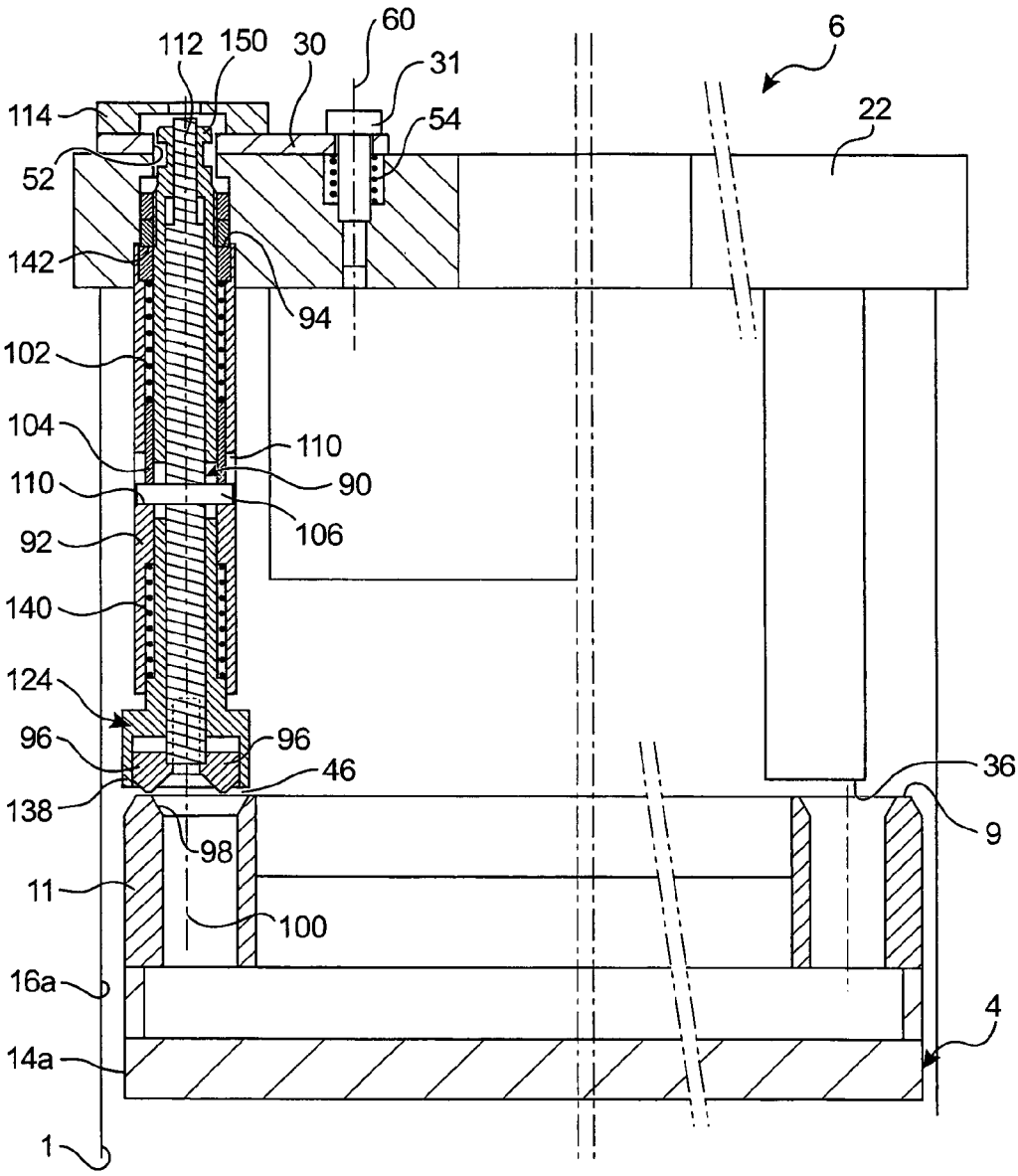
FIG. 11*a* shows a partial sectional view of the monitoring device shown in FIG. 10.

With reference to FIG. 11*a* also showing a mobile stop device 124, it can be seen that said device takes the form of a thruster oriented in the direction 8 and wherein a lower end 138 is close to the tip 11 of the assembly resting in the bottom of the housing 1. At this stage, the locking system 6 has only been positioned on the upper part of the housing 1 with which it is in contact, but it has not yet been tightened. For this reason, the assembly 4 occupies an axial position prohibiting transport, which is conveyed by the absence of contact between the upper surface 9 and the lower horizontal surface 36 of the plate 22.

Therefore, the axial thruster 124 is in the lowest position provided by elastic return means preferentially taking the form of a compression spring 140 inserted between a hollow body 92 of the device 20 and the lower end 138, the components 124, 140 and 92 being concentric. Moreover, the lowest position is retained by means of a stop between a shoulder 142 of the thruster 124, possibly being formed by a ring, and an upper end 94 of the hollow body 92 attached to the plate 22, said stop actually limiting the downward stroke of the thruster 124. In this position, the lower end 138 and the upper surface 9 are spaced by a clearance 46. In addition, an upper end 150 of said thruster 124 is housed in a through orifice 52 of the flap 30, the orifice 52 and the end 150 having a substantially identical diameter.

Therefore, the stop between said two components 150 and 52 makes it possible to hold the flap 30 in the position indication position prohibiting transport shown in FIG. 10. In fact, without this stop, the flap 30 would be rotated around the axis 60 of the pivot 31 via the torsion spring 54 wherein the lower end is attached to the plate 22, and wherein the upper end is attached to the flap 30.

Figure 11B:
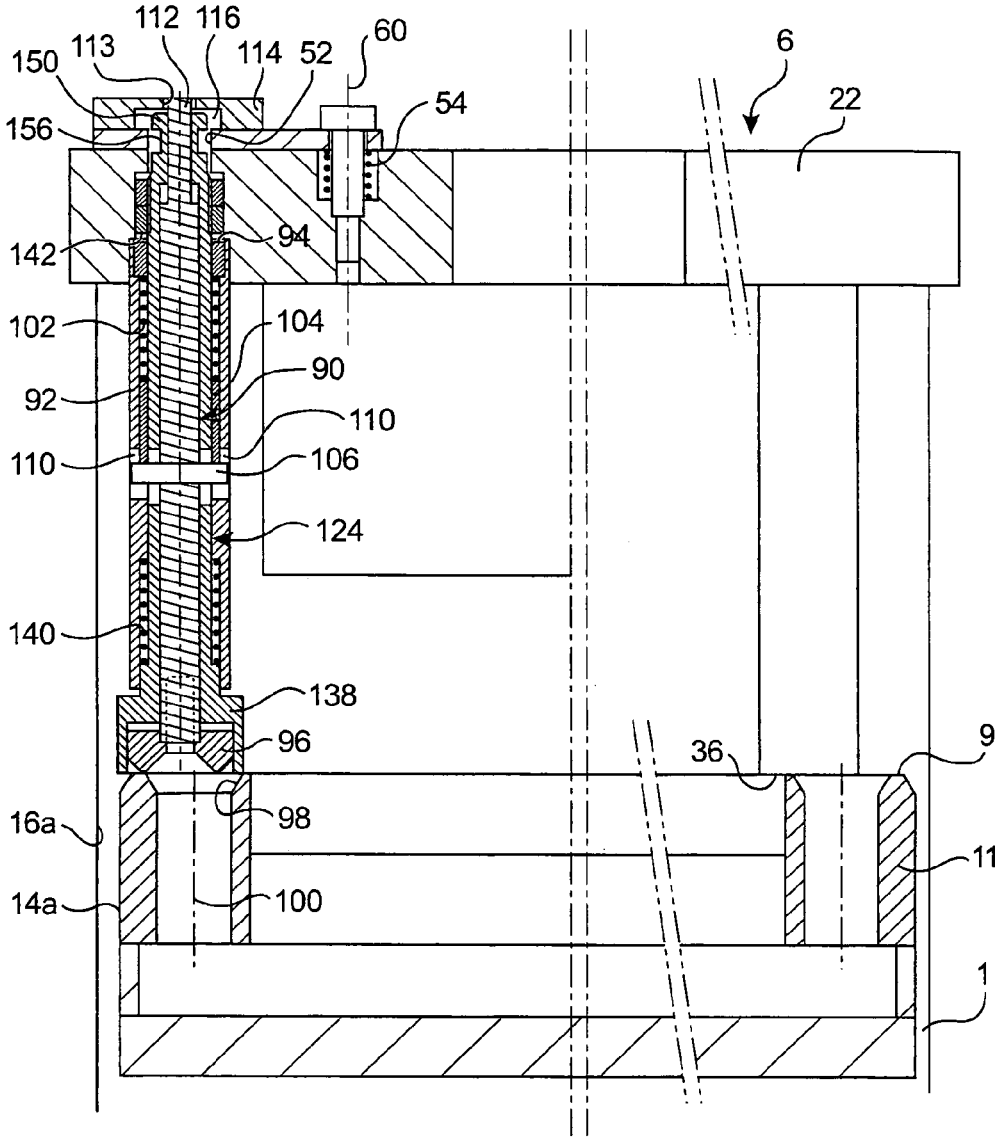
FIG. 11*b* shows a similar view to that in FIG. 11*a*, in a configuration wherein the axial position of the assembly in its housing is satisfactory.

With reference now to FIG. 11*b* showing the device 20 in a configuration wherein the axial position of the assembly 4 in its housing 1 is satisfactory, it can be seen that said assembly has been sufficiently tightened by the locking system 6 so that pressing of the surface 9 of the upper end 11 is induced against the lower surface 36 of the plate 22.

During this tightening, the upward movement of the assembly 4 in the housing 1 results in the surface 9 and the lower end 138 of the thruster 124 coming into contact. As a result, the tip 11 exerts an action on the thruster 124 which then moves upwards compressing the spring 140, until the surfaces 9 and 36 are at a stop, as represented in FIG. 11*b*. In this position, it can be seen that the thruster 124 has been sufficiently moved upwards so that its end 150 is fully extracted from the orifice 52, which is now facing a throat 156 of said thruster, and located below the end 150.

The diameter of said throat 156 is substantially identical to the width of the groove 58 (visible in FIG. 10) taking the form of an arc of a circle centred on the axis 60 of the pivot 31, and opening into the abovementioned orifice 52. In this way, in this state, the thruster 124 no longer holds the flap 30 at a stop, as a pivoting thereof along the axis 60 would result in an engagement of the circular groove 58 in the throat 156, and a relative sliding between said two components 156, 58. Moreover, it can naturally be seen that there is no longer a stop between the components 142 and 94, the thruster assembly 124 arranged inside the hollow body 92 having been moved upwards in the axial direction 8.

Again with reference to FIG. 11*a* showing the fourth mobile stop device 90, it can be seen that said device also takes the form of a thruster oriented in the direction 8 and wherein a lower end 96 is close to the tip 11 of the assembly resting in the bottom of the housing 1. Said end 96 of tapered shape of a parallel axis 100 with the direction 8 is also referred to as the contact end, as it is intended to be housed in an orifice 98 of complementary shape, provided on the tip 11 of the assembly. Moreover, as can be seen clearly in FIG. 11*a*, the thruster 90 is arranged concentrically with respect to the components 124 and 92, and passes through the thruster 124.

At this stage where the locking system 6 has not yet been tightened, the assembly 4 occupies a lateral position prohibiting transport, which is conveyed by the absence of contact between the lateral surface 14*a* of the assembly and the lateral surface 16*a* of the housing, and between the lateral surface 14*b* of the assembly and the lateral surface 16*b* of said housing (the surfaces 14*b* and 16*b* not being visible in FIG. 11*a*).

The thruster 90 is in this case in the lowest position provided by elastic return means preferentially taking the form of a compression spring 102 inserted between the hollow body 92 and a brace 104 pressing against an upper portion of a rod 106 passing orthogonally through the thruster 90. Moreover, the lowest position is retained by means of a stop between both ends of said rod 106 and the bottom of two slots 110 created in lateral faces of the hollow body 92, therefore, said stop limiting the downward stroke of the thruster 90. In this position, the lower end 96 and the upper end 9 are for example in contact with each other, or very close, which implies that the end 96 projects slightly from the end 138, downwards. Moreover, an upper end 112 of said thruster 90 projects upwards from the upper end 150 of the thruster 124.

With reference to FIG. 11*b* showing the device 20 in a configuration wherein the axial position of the assembly in its housing is satisfactory but wherein the lateral position of the assembly in its housing is such that the transport is still prohibited, it can be seen that the raising of the assembly 4 in the housing 1 has not only caused upward movement of the thruster 124, but also upward movement of the concentric thruster 90, due to the contact of the end 96 with the tip 11. In this position enabled by the compression of the spring 102 and the movement of the rod 106 in the slots 110 oriented in the direction 8, the ends 96 and 138 are located on the same transversal and horizontal plane. Moreover, again in this position shown in FIG. 11*b*, the upper end 112 of said thruster 90 has entered a through orifice 113 of a plate 114 attached above the flap 30, the orifice 113 and the end 112 having a substantially identical diameter. This plate 114 comprises on its lower surface a recess 116 making it possible to house the end 150 fully extracted from the orifice 52.

Therefore, the stop between these two components 112, 113 makes it possible to hold the flap 30 in the position indication position prohibiting transport shown in FIG. 10.

Figure 11C:
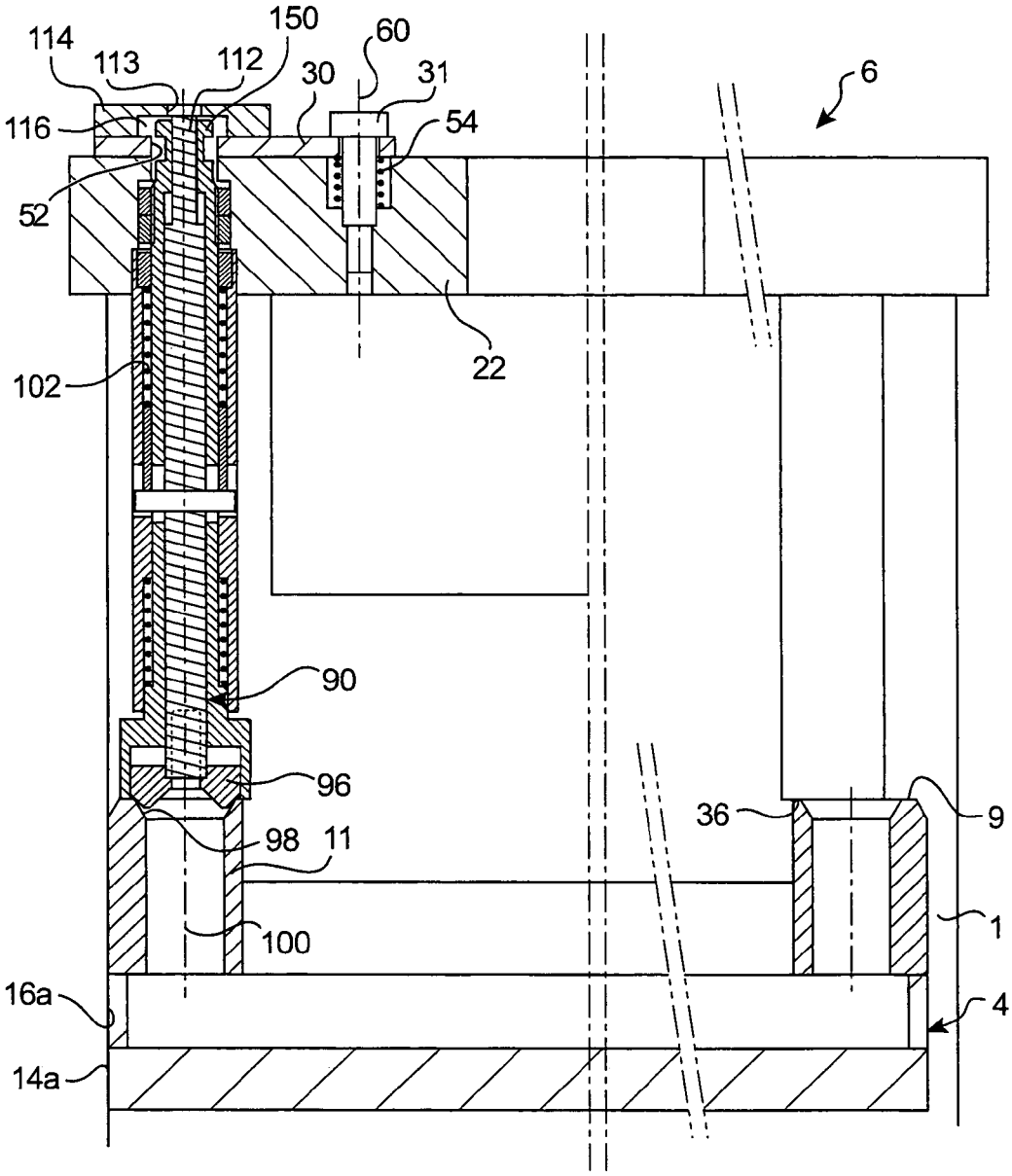
FIG. 11*c* shows a similar view to that in FIG. 11*b*, in a configuration wherein the lateral position of the assembly in its housing is satisfactory.

With reference now to FIG. 11*c* showing the device 20 in a configuration wherein the lateral and axial positions of the assembly 4 in its housing 1 are both satisfactory, it can in fact be seen that this assembly has been sufficiently tightened by the locking system 6 so that pressing of the lateral surface 14*a* of the assembly 4 is induced against the lateral surface 16*a* of the housing 1, along with pressing of the lateral surface 14*b* of the assembly 4 against the lateral surface 16*b* of said housing 1 (the surfaces 14*b* and 16*b* not being visible in FIG. 11*c*).

During this tightening, the lateral movement of the assembly 4 in the housing 1, in the direction of the surfaces 16*a* and 16*b*, results in the orifice 98 of the tip 11 being centred with respect to the contact end 96 of tapered shape. Once this is performed, the action of the compression spring 102 on the thruster 90 induces an automatic downward movement thereof, enabled by an entry of the end 96 in the orifice 98, as can be seen in FIG. 1I c. As such, it is noted that the orifice 98 could be replaced by any means liable to be entered by the end 96 of the thruster 90, such as a groove extending parallel with an edge of the tip 11. As a more general rule, said means and the shape of the end 96 are selected in any manner, the only condition being that they make it possible to monitor the lateral position of the assembly in a plane orthogonal to the axis 100 parallel with the direction 8, i.e. in two separate directions orthogonal with said direction 8.

In this position, it can be seen that the end 112 has been moved sufficiently downwards to be fully extracted from the orifice 113. In fact, the upper end 112 is now housed in the end 150 of the thruster 124, and therefore arranged in the recess 116 of the plate 114. In this way, in this state, the thruster 90 no longer holds the flap 30 at a stop.

At the end of the tightening of the locking system 6, both mobile stop devices 124, 90 alone making it possible to monitor the contact of three orthogonal surfaces of the assembly 4 are normally positioned in the state shown in FIG. 11*c*, wherein they no longer hold the flap 30 at a stop. Therefore, from this time, the free flap 30 is only subject to the action of the torsion spring 54 which induces pivoting thereof around the axis 60, therefore, during which the throat 156 slides in the circular groove 58, as shown by the final position of FIG. 12.

Figure 12:
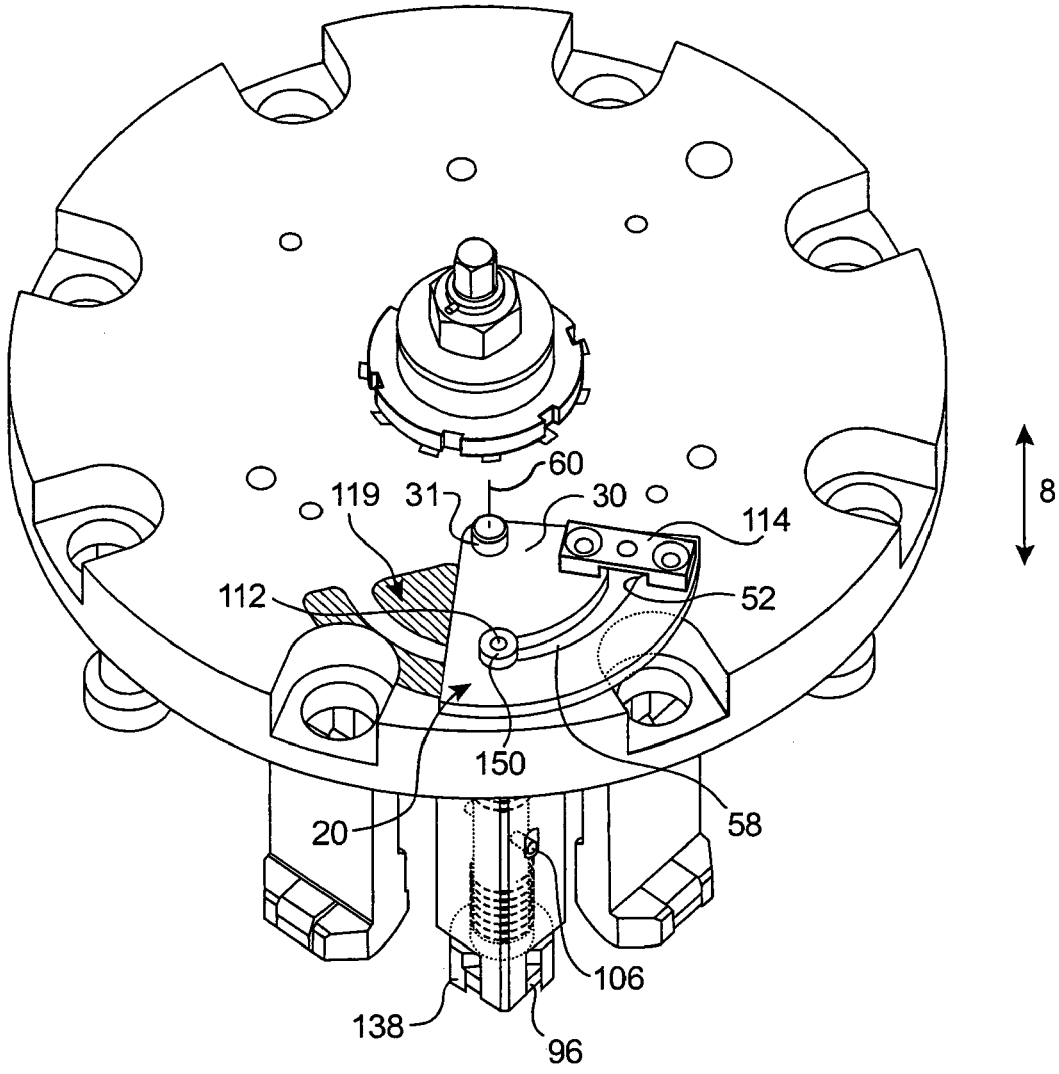
FIG. 12 represents a similar view to that shown in FIG. 10, the monitoring device being located in a configuration wherein the position of the assembly in its housing is such that transport is enabled.

In FIG. 12 showing the monitoring device 20 located in a configuration wherein the position of the assembly in its housing is such that transport is enabled, it can be seen that the flap 30 having been moved automatically under the effect of the spring 54 is stopped in a specific angular position by a stop between the throat 156 (not visible in FIG. 12) and an end of the through groove 58 opposite that opening into the orifice 52.

In this position indication position enabling transport, the angular position of the flap 30 with respect to the plate 22 is such that it covers the first marking zone 34 while revealing another zone 119, the latter also being created on the upper surface of said plate 22 and produced so as to indicate clearly and precisely to the operator that the assembly 4 is correctly positioned in the housing 1. Naturally, this zone 119 preferentially adopts a different colour to that of the first zone 34.

Naturally, various changes may be made by those skilled in the art to the tightening system and the monitoring devices described above, only as non-limitative examples.

In particular, while both preferred embodiments have been described with reference to a nuclear fuel assembly, it should be understood that the invention also applies to any assembly containing nuclear fuel designed to be positioned in a storage box housing, such as for example a fuel rod housing, and preferentially displaying a polygonal cross section, such as a square.

In addition, it is noted that the monitoring device may not only be incorporated in a locking system designed to be fitted in a given storage basket housing but could alternatively be mounted directly thereon.

Finally, it is noted that while the two preferred embodiments described above are devised such that they make it possible to indicate to an operator that the assembly is either in a position prohibiting transport (after the loading of the assembly, and conveying one or more non-satisfactory contacts), or in a position enabling transport (after the tightening of the locking device, and conveying satisfactory contacts), or possibly in a position enabling its unloading (after the transport and release of the locking system, and conveying the unloading of the assembly in the bottom of the housing), the invention also applies to devices designed to only indicate a position prohibiting the unloading and a position enabling the unloading of the assembly. In the latter case, the device of a similar design to any of those described above is produced such that the transition of the assembly from the position prohibiting unloading to the position enabling unloading is identical to the transition described above from the position enabling transport to the position enabling unloading, as in both cases, the assembly changes from a state wherein it is at a distance from the bottom of the housing to a state wherein it is in contact with said bottom or very close thereto.

What is claimed is:

1. A monitoring device of the position of an assembly containing nuclear fuel in a housing of a storage basket comprising:

at least one mobile stop device; and a position indicator held at a stop in a first position by the mobile stop device when the mobile stop device is disposed in a first position, the first position of the position indicator indicating that the assembly occupies a first position in the housing, said mobile stop device being disposed to assume a second position following contact with the assembly when the assembly is disposed in a second position in the housing, the second position of the mobile stop device causing the mobile stop device to release the position indicator from the held first position and to permit the position indicator to automatically move from the first position to a second position indicating that the assembly occupies said second position.

2. A monitoring device according to claim 1, wherein said first position of the assembly corresponds to a position prohibiting transport and causing the position indicator to indicate that the assembly is in a position prohibiting transport of the assembly, and wherein said second position of the assembly corresponds to a position enabling transport and causing the position indicator to indicate the assembly is in a position enabling transport of the assembly.

3. A monitoring device according to claim 2, wherein the position indicator is held at a stop by at least one mobile stop device in said second position indication position enabling transport, said mobile stop device being disposed to move to the first position when the assembly is placed in the first position enabling the unloading of the assembly from the housing and to thereby release the held position indicator to cause the position indicator to move automatically from said second position, indicating a position enabling transport, to a third position indication position enabling unloading of the assembly.

4. A monitoring device according to claim 1, wherein said first position of the assembly corresponds to a position prohibiting the unloading of the assembly and causing the position indicator to indicate that the assembly is in a position prohibiting the unloading of the assembly, and wherein said second position of the assembly corresponds to a position enabling the unloading of the assembly from the housing and causing the position indicator to indicate that the assembly is in a position enabling the unloading of the assembly.

5. A monitoring device according to claim 1, wherein the monitoring device comprises a plurality of mobile stop devices, each suitable for holding the position indicator at a stop in said first position.

6. A monitoring device according to claim 1, wherein the monitoring device comprises a first mobile stop device arranged to move in translation in a first direction.

7. A monitoring device according to claim 6, wherein said first mobile stop device takes the form of a thruster equipped with a throat cooperating with a groove created in said position indicator.

8. A monitoring device according to claim 6, wherein the monitoring device also comprises a second mobile stop device and a third mobile stop device respectively arranged to pivot around a second direction and a third direction, the first, second and third direction being orthogonal with each other.

9. A monitoring device according to claim 8, wherein said first, second and third mobile stop devices are equipped with elastic return means.

10. A monitoring device according to claim 9, wherein the monitoring device comprises a fourth mobile stop device arranged to move in translation in said first direction, said fourth mobile stop device having a contact end of tapered shape, of a parallel axis with said first direction.

11. A monitoring device according to claim 10, wherein said fourth mobile stop device is equipped with elastic return means.

12. A monitoring device according to claim 1, wherein said position indicator takes the form of a flap equipped with elastic return means configured to cause automatic movement of the flap from said first position to said second position.

13. A monitoring device according to claim 1, wherein said position indicator cooperates with marking created on a support of said indicator.

14. A monitoring device according to claim 1, wherein the monitoring device is configured with a plurality of mobile stop devices and position indicators to monitor the position of a corresponding plurality of assemblies, each assembly being housed in a respective housing of a storage basket.

15. A locking system of an assembly containing nuclear fuel in a housing of a storage basket, said system providing axial and lateral support of the assembly in the housing, and being equipped with a monitoring device according to claim 1.

* * * * *